US010160131B2

(12) United States Patent
Cieslikowski et al.

(10) Patent No.: US 10,160,131 B2
(45) Date of Patent: Dec. 25, 2018

(54) DETACHABLE CUTTING HEAD FOR THE APPARATUS FOR FEEDING SETS OF FILTER SEGMENTS, DRIVE APPARATUS FOR DETACHABLE CUTTING HEAD AND METHOD OF REPLACEMENT OF DETACHABLE CUTTING HEAD

(75) Inventors: Bartosz Cieslikowski, Radom (PL); Ryszard Dominiak, Radom (PL); Leszek Sikora, Radom (PL); Andrzej Boleslawski, Radom (PL)

(73) Assignee: Philip Morris Products S.A., Neuchatel (CH)

( * ) Notice: Subject to any disclaimer, the term of this patent is extended or adjusted under 35 U.S.C. 154(b) by 492 days.

(21) Appl. No.: 14/114,866

(22) PCT Filed: May 22, 2012

(86) PCT No.: PCT/PL2012/050013
§ 371 (c)(1),
(2), (4) Date: Jan. 9, 2014

(87) PCT Pub. No.: WO2012/161605
PCT Pub. Date: Nov. 29, 2012

(65) Prior Publication Data

US 2014/0123826 A1 May 8, 2014

(30) Foreign Application Priority Data

May 23, 2011 (PL) ..... 394994

(51) Int. Cl.
*B26D 1/24* (2006.01)
*B26D 5/22* (2006.01)
(Continued)

(52) U.S. Cl.
CPC ..... *B26D 5/22* (2013.01); *A24D 3/0254* (2013.01); *B26D 1/24* (2013.01); *B26D 7/26* (2013.01);
(Continued)

(58) Field of Classification Search
CPC ..... B26D 1/24; B26D 5/22; Y10T 83/4818; A24D 3/025; A24D 3/0245; A24D 3/0258
(Continued)

(56) References Cited

U.S. PATENT DOCUMENTS 2,716,449 A 8/1955 Larsen
3,253,491 A 5/1966 Rakowicz
(Continued)

FOREIGN PATENT DOCUMENTS

CN 201709389 A2 1/2011
CN 201824408 A2 5/2011
(Continued)

OTHER PUBLICATIONS

English Translation of the CN Search Report, dated Oct. 21, 2014.
(Continued)

*Primary Examiner* — Sean Michalski
*Assistant Examiner* — Fernando Ayala
(74) *Attorney, Agent, or Firm* — Mueting, Raasch & Gebhardt, P.A.

(57) ABSTRACT

The object of the application is a detachable cutting head for an apparatus for feeding filter segments provided with a drum conveyor having flutes for crosswise movement of filter rods, provided with circular knives situated in knife units mounted in the housing of the head, characterized in that it comprises a housing of the head (8) provided with a reference surface (23) for positioning in the apparatus for feeding filter segments; seatings (20, 21) for positioning the knife units (10) and lead-out channels (25), knife units (10)
(Continued)

Figure 1:
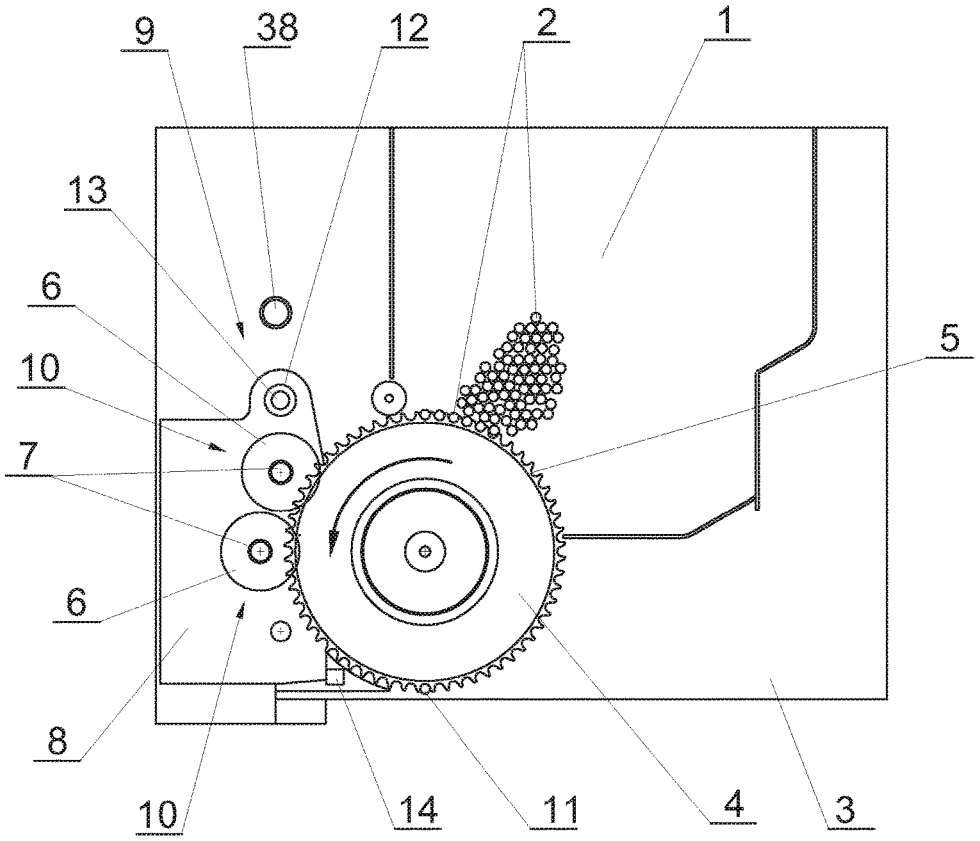

with circular knives (6), whereas the positioning seatings (20, 21) are situated so that the circular knives (6) do not overlap. Furthermore, the object of the application is a drive apparatus of a cutting head and a method of coupling a cutting head.

12 Claims, 4 Drawing Sheets

(51) Int. Cl.
*A24D 3/02* (2006.01)
*B26D 7/26* (2006.01)
*B26D 7/00* (2006.01)

(52) U.S. Cl.
CPC ..... *B26D 7/2614* (2013.01); *B26D 7/00* (2013.01); *Y10T 29/49826* (2015.01); *Y10T 83/6539* (2015.04)

(58) Field of Classification Search
USPC ..... 83/500, 503, 305, 345, 328, 304, 549; 74/10.5
See application file for complete search history.

(56) References Cited

U.S. PATENT DOCUMENTS 3,575,329 A * 4/1971 Hannabery ..... B26D 1/245 225/103
3,731,451 A 5/1973 Sexstone et al.
3,929,048 A * 12/1975 McGehee ..... B27B 3/02 83/425.2
5,158,002 A * 10/1992 Matsunaga ..... B23D 35/008 83/479
5,692,440 A * 12/1997 Hillebrand ..... B26D 1/626 101/224
5,765,460 A * 6/1998 Wathieu ..... B23D 36/005 83/311
5,802,938 A * 9/1998 Fournier ..... B26D 1/30 83/175
6,032,560 A * 3/2000 Puchovsky ..... B23D 25/12 83/304
6,032,579 A * 3/2000 Richards ..... B41F 7/12 101/219
7,000,517 B1 * 2/2006 Spix ..... B26D 1/626 83/343
2006/0000324 A1 1/2006 Johnson
2007/0163371 A1 * 7/2007 Blach ..... B29C 47/0801 74/325
2009/0145449 A1 * 6/2009 Cieslikowski ..... A24D 3/0287 131/280

FOREIGN PATENT DOCUMENTS

DE 1258318 B 1/1968
FR 1430618 A 3/1966
FR 2358845 A1 7/1977
GB 924126 A 4/1963
GB 1043706 A 9/1966
NL 7105872 A 10/1972
PL 368000 A1 3/2005
PL 383995 A1 6/2009

OTHER PUBLICATIONS

English Translation of the International Search Report, dated Jun. 13, 2011.
International Search Report for International Application No. PCT/PL2012/050013 dated Feb. 28, 2013.
Written Opinion for International Application No. PCT/PL2012/050013 dated Feb. 28, 2013.

* cited by examiner

DETACHABLE CUTTING HEAD FOR THE APPARATUS FOR FEEDING SETS OF FILTER SEGMENTS, DRIVE APPARATUS FOR DETACHABLE CUTTING HEAD AND METHOD OF REPLACEMENT OF DETACHABLE CUTTING HEAD

The object of the application is a detachable cutting head for an apparatus for feeding sets of filter segments of the tobacco industry, a drive apparatus for a detachable cutting head and a method of replacement of a detachable cutting head.

In machines manufacturing multi-segment filters, there is a need of feeding multiple different filter segments from multiple feeding apparatuses. Among known segment feeding apparatuses are apparatuses for feeding sets of filter segments, where one set of segments is formed by cutting one filter rod conveyed on a drum using a cutting head provided with circular knives. From patent GB 1043706, a detachable cutting head provided with several circular knives mounted on knife shafts is known, whereas the power transmission and coupling of the knife shafts is effected by means of a toothed gear disposed in the housing of the cutting head. The replacement of the circular knife requires dismantling of the knife shaft on which the knife is mounted, whereas during pushing the shaft out of the housing the knives successively slide down of the shaft and remain inside the housing. In order to install a new circular knife, the knife shaft is pushed into the housing, and then the knives are successively put onto the shaft which is partially inserted into the housing.

The object of the invention is a detachable cutting head for an apparatus for feeding filter segments provided with a drum conveyor having flutes for crosswise movement of filter rods, provided with circular knives situated in knife units fastened in the housing of the head, characterized in that it comprises a housing of the head provided with a reference surface for positioning in the apparatus for feeding filter segments, seatings for positioning knife units and lead-out channels, as well as knife units with circular knives. The positioning seatings are situated in such a way that circular knives do not overlap.

A head according to the invention is also characterized in that it comprises a second reference surface for positioning knife units.

Furthermore, a head according to the invention is characterized in that the knife shafts have different lengths.

Alternatively a head according to the invention is characterized in that the knife shafts have equal lengths.

The object of the invention is also a drive apparatus for a detachable cutting head in an apparatus for feeding filter segments provided with a drum conveyor having flutes for crosswise movement of filter rods, characterized in that the drive apparatus is movably mounted in the apparatus for feeding filter segments, and in addition it comprises means for positioning of the drive apparatus and a set of drive shafts cooperating with the knife shafts of the cutting head.

A drive apparatus according to the invention is characterized in that the drive shafts have different lengths.

Optionally, a drive apparatus according to the invention is characterized in that the drive shafts have equal lengths.

The object of the invention is also a method of connecting a detachable cutting head with a drive apparatus characterized in that the cutting head is placed in the apparatus for feeding filter segments provided with a drum conveyor having flutes for crosswise movement of filter rods so that a reference surface comes into contact with a reference surface of the apparatus, the angular position of knife shafts relative to drive shafts is determined, the drive unit is shifted by positioning means towards the cutting head, and then the knife shafts are coupled with the drive shafts.

A method according to the invention is characterized in that in the event when drive shafts or knife shafts have different lengths or are shifted relative to each other, the angular position of the knife shafts and the shift of the drive unit are effected consecutively for the knife shafts.

The drive of the knife shafts in the detachable cutting head according to the invention is situated outside the housing of the head which results in that the cutting head itself has a simplified construction as compared to known heads, and the elements of drive systems which may require lubrication are moved away from the area of flow of the filter segments. Furthermore, the replacement of circular knives does not require interference in the drive system. After the removal of the cutting head, each knife shaft unit can be removed as a whole independently of other units, which greatly accelerates and facilitates the replacement of worn out or damaged knives.

Figure 2:
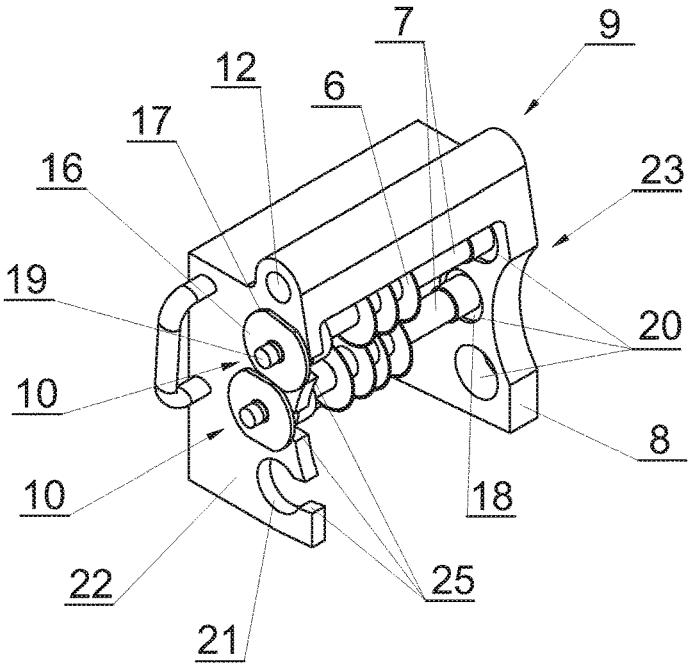
Figure 3:
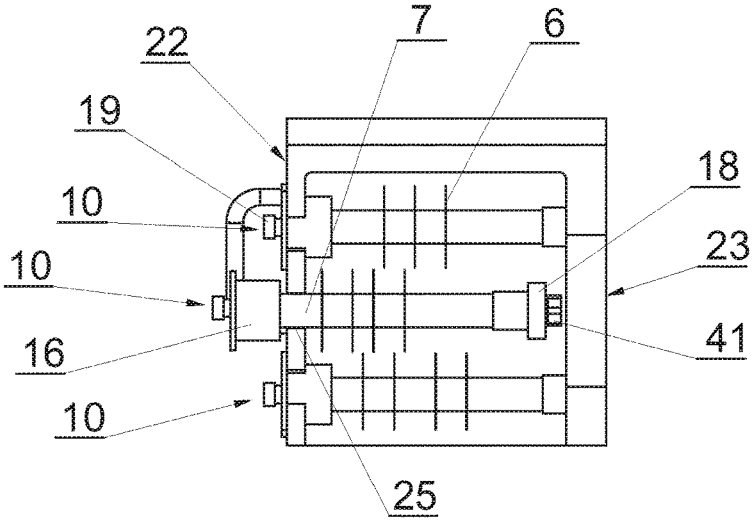
Figure 4:
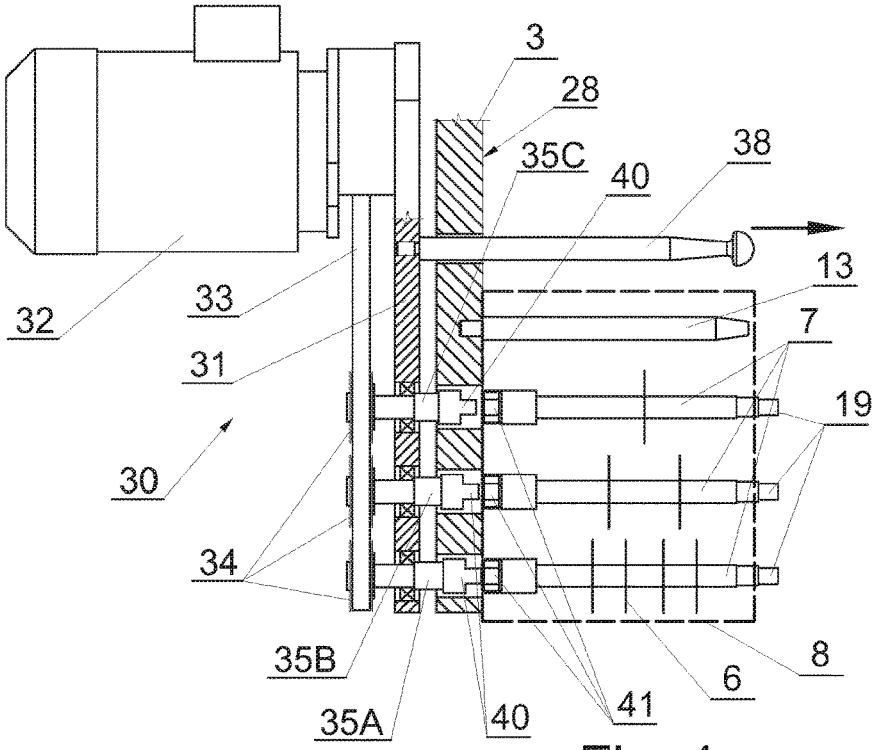
Figure 5:
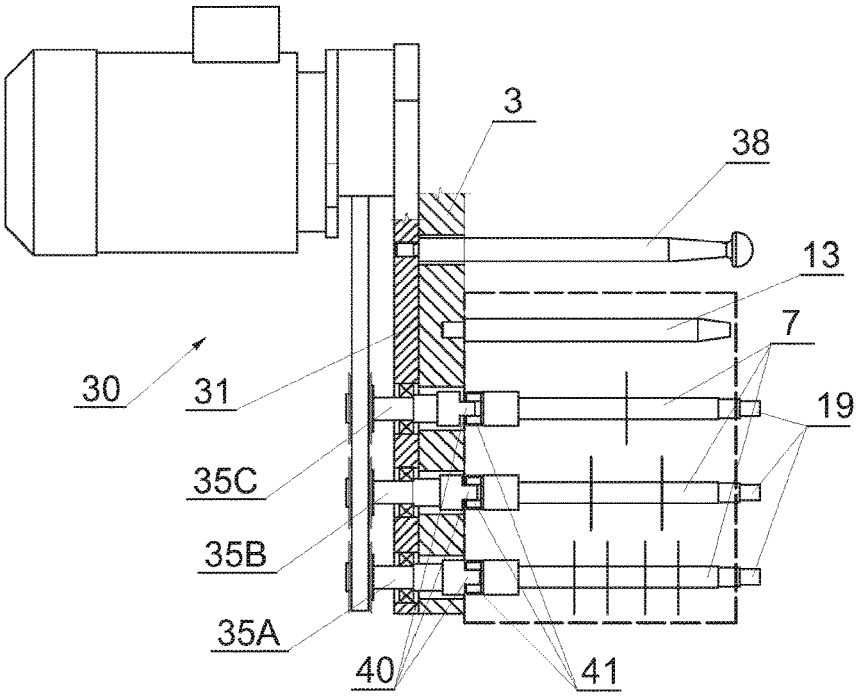
Figure 6:
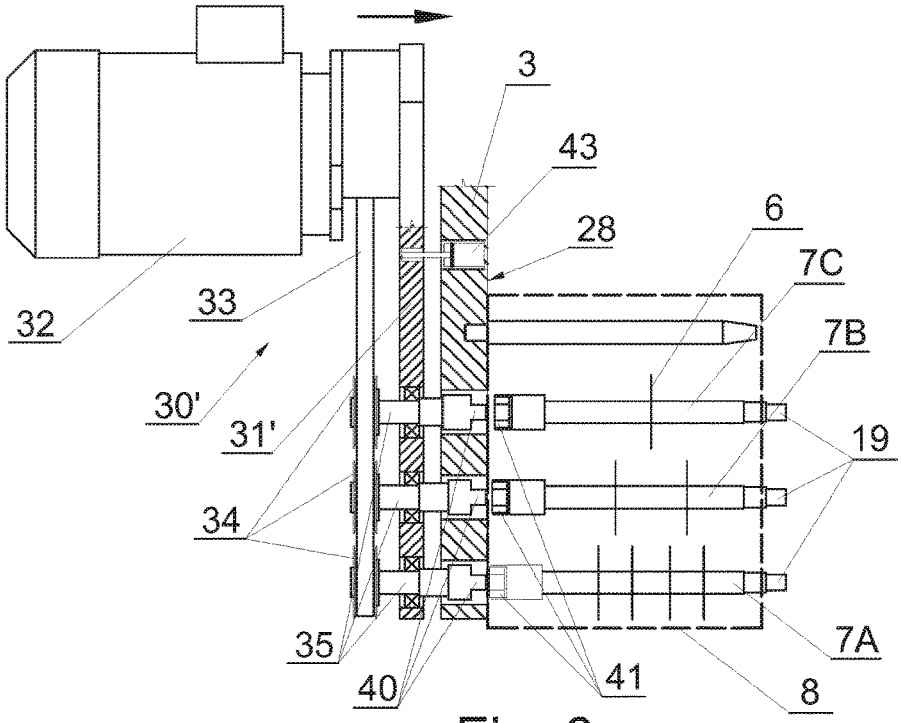
Figure 7:
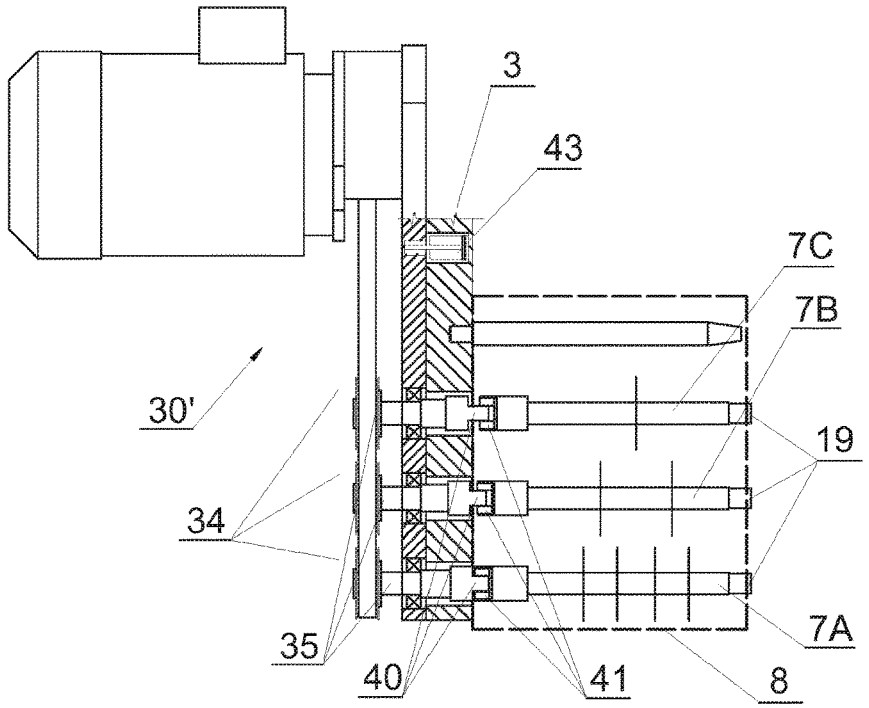

The object of the invention is shown in a preferred embodiment in a drawing in which:

FIG. 1—shows a view of an apparatus for feeding sets of filter segments,

FIG. 2—a perspective view of a cutting head with two knife shafts,

FIG. 3—a cutting head with three knife shafts,

FIG. 4—a drive apparatus of a cutting head provided with a manual pull rod for changing the position, in uncoupled position, FIG. 5—the apparatus of FIG. 4 in coupled position, FIG. 6—a drive apparatus of a cutting head provided with an actuator for changing the position, in uncoupled position, FIG. 7—the apparatus of FIG. 6 in coupled position.

FIG. 1 shows an apparatus for feeding sets of filter segments provided with a hopper 1 for filter rods 2 mounted on a main plate 3. Beneath the hopper 1 there is a cutting drum 4 provided on the circumference with a plurality of flutes 5 in which the filter rods 2 from the hopper 1 are placed and in which the said rods are conveyed. The filter rods 2 are transported crosswise to their axes, in the direction of rotation of the drum that is marked with an arrow and are cut into segments by circular knifes 6 which are mounted on knife shafts 7 that are mounted in a housing 8 of a cutting head 9, whereas during the operation the cutting edges of circular knives 6 are inserted into circumferential flutes formed in the drum 4. Depending on the quantity of filter segments into which the filter rods are cut, the cutting head 9 is provided with one or more sets of circular knives 6 mounted on the knife shafts 7. Hereinafter, the knife shaft 7 with knives 6, distance sleeves, spacers, bearings and other elements mentioned below will be referred to as a knife shaft unit 10 or a knife unit 10. A set of filter segments 11 formed by cutting a filter rod 2 is picked up usually in the lowest position of the flute 5. An opening 12 formed in the housing 8 is used to position the head 9. After sliding the housing 8 on a mandrel 13 attached to the main plate 3, the housing 8 is leant against the main plate 3 or another resistance element. In the operating position, the housing is also leant against a resistance element 14 fastened to the main plate 3. For the sake of simplicity, the bolts fastening the cutting head 9 have not been shown in the drawing. FIG. 2 shows a cutting head 9 provided with two shafts 7 belonging to the knife units 10, whereas the knife unit 10 comprises also knives 6, distance sleeves and spacers between the knives, a sleeve 16, bearings, a coupling element and an end piece 19 for a manual shaft rotation. The unit 10 is disposed in the housing 8 in positioning seatings 20 and 21, where the sleeve 16 provided with a bearing is pushed into a hole 21, and a flange 17 of the said sleeve rests on a surface 22, whereas the bearing 18 is pushed into a hole 20. For the sake of simplicity, the connecting elements fastening the sleeve 16 to the housing 8 have been omitted in the drawing. An end piece 19 is mounted on the knife shaft 7, by means of the said end piece the shaft 7 with the knives 6 may be manually rotated.

At the holes 21, lead-out channels 25 which facilitate the removal of knife units 10 are formed. FIG. 3 shows a view of a cutting head 9 with three units 10, whereas the central unit 10 is axially pushed out of its working position and may be removed from the housing 8 independently of other units 10 in a direction principally perpendicular to the axis of rotation of the shaft 7 through the lead-out channel 25 the width of which is greater than the diameter of the shaft 7. Axial displacement of each of central units 10 independently from the other units is possible as the outer edges of knives 6, in the view perpendicular to the plane of knives 6, do not overlap with each other.

The housing 8 of the cutting head is provided with two surfaces 22 and 23 which are parallel to each other. A reference surface 23 is arranged to lean against the main plate 3, which makes it possible to position the housing 8 relative to the main plate 3. A surface 22 opposite to the surface 23 is a reference surface for positioning the knife units 10. Furthermore, the knives 7 are precisely arranged by means of distance sleeves relative to the flange 18 which rests on the surface 22. As it can be seen from the description, the construction of the cutting head makes it possible to easily replace damaged or worn out knives and ensures keeping an exact position of the knives 7 in relation to the plate 3 relative to which the cutting drum is positioned. In the case that one of the knives is damaged, the cutting head 9 is unscrewed of the support plate 3 or other supporting elements. The head 9 is to be deflected from the cutting drum, and then pushed down of the mandrel 13. After pushing out the knife unit 10, damaged or worn out knives 6 are replaced while the position of the distance elements and spacers is kept, and their position relative to the flange 17 of the sleeve 16 is checked. A unit 10 with replaced knives is pushed crosswise to the axis of the unit into the housing of the cutting head, and then along the axis and is fastened using connecting elements. The cutting head prepared in such a way is put onto the guiding mandrel, leant against the support plate, rotated in the direction of the cutting drum 4 and screwed down to the main plate. Below a method of coupling knife shafts of the cutting drum with the drive apparatus is presented.

FIG. 4 shows a drive apparatus 30 of the cutting drum provided with a support plate 31 on which a motor 32 is mounted. The apparatus 30 is provided with drive shafts; each of the drive shafts 35A, 35B, 35C of the drive apparatus 30 driven by a belt 33 is mounted on the support plate 31 and has a drive wheel 34 at one end, and a coupling element 40 at the other end, whereas the drive shafts 35A, 35B and 35C have different lengths. In the embodiment shown in the drawing the shaft 35A is the longest, and the shaft 35C is the shortest. The drive shafts can be also driven by a toothed gear or another gear of any type. The drive apparatus 30 is mounted on typical linear guides (not shown) enabling the apparatus to move horizontally in the direction corresponding to the axes of the drive shafts 35, whereas the apparatus 30 in FIG. 4 is in uncoupled position when the coupling elements 40 do not come into contact with the coupling elements 41 and the drive is not transmitted to the knife shafts 7 of the cutting head 9. In the drawing, only a border shape of the housing 8 of the cutting head 9 is shown in broken lines, whereas the housing is leant against the reference surface 28. A change of position of the drive apparatus 30 is effected by apparatus positioning means in the form of a manually operated pull rod 38. In order to couple the knife shafts 7 of the head 9 the operator shifts the drive apparatus 30, in the direction shown by the arrow, with the use of the pull rod 38 until the moment when the coupling element 40 mounted on the shaft 35A comes into contact with the respective coupling element 41 mounted on the knife shaft 7. At this moment, the shaft 7 and the element 41 are to be manually rotated by means of the end piece 19 so as to adjust the angular position of the coupling element 41 to element 40 in order to enable the elements 40 and 41, thus the shaft 35A and the shaft 7, to engage. Elements 40 and 41 can be elements of any known disengaging coupling. After the shaft 35A has been engaged with the shaft 7, the operator shifts the drive apparatus by means of the pull rod 38 until the moment when the coupling element 40 mounted on the shaft 35B comes into contact with the respective coupling element 41 mounted on the respective knife shaft 7. Similar to the shaft 35A, the shaft 7 respective to the shaft 35B is to be rotated in order to enable them to engage. In case of the shaft 35C the procedure is similar to that for the shafts 35A and 35B. FIG. 5 shows the position of the apparatus 30 after all knife shafts 7 have been coupled with the drive shafts 35A, 35B and 35C.

The embodiment presented in FIG. 6 shows a drive apparatus 30' which consists of similar elements as the drive apparatus 30, however, the plate 31' is arranged to cooperate with a pneumatic actuator 43 which replaces manual shifting of the drive apparatus by the operator. In this embodiment the drive shafts 35 have an equal length whereas the knife shafts 7A, 7B and 7C have different lengths, the shaft 7A is the longest, and the shaft 7C is the shortest. Similar to the previous embodiment, the drive shafts 35 are provided with the coupling elements 40, and the knife shafts 7A, 7B and 7C are provided with the coupling elements 41. A change of position of the drive apparatus 30' is effected by apparatus positioning means in the form of the pneumatic actuator 43. In order to couple the knife shafts 7A, 7B and 7C of the head 9 the pneumatic actuator 43 shifts the drive apparatus 30' in the direction shown by the arrow until the moment when the coupling element 40 mounted on the shaft 35 comes into contact with the corresponding coupling element 41 mounted on the knife shaft 7A. At this moment the shaft 7 is to be manually rotated by means of the end piece 19 so as to adjust the angular position of the coupling element 41 to the element 40 in order to enable the elements 40 and 41, thus the shaft 35 and the shaft 7A, to engage. After the shaft 35 has been engaged with the shaft 7A, the pneumatic actuator 43 shifts the drive apparatus until the moment when the coupling element 40 mounted on the shaft 35 comes into contact with the corresponding coupling element 41 mounted on the knife shaft 7B. Similar to the shaft 7A, the shaft 7B is to be rotated in order to enable the shaft 35 and the shaft 7B to engage. In case of the shaft 7C the procedure is similar to that for the shafts 7A and 7B. FIG. 7 shows the position of the apparatus 30' after the knife shafts 7A, 7B and 7C have been coupled with the drive shafts 35. Both embodiments described above relate to sequential coupling of individual knife shafts with drive shafts. Sequential shaft coupling will be also required if the drive shafts have an equal length, and the knife shafts of equal length are axially shifted relative to each other. If all drive shafts of equal length and all knife shafts of equal length not axially shifted are used, simultaneous angular positioning of all coupling elements will be necessary in order to make simultaneous coupling of all pairs of shafts during shifting of the drive apparatus possible. For the change of position of the drive apparatus other known actuating elements with pneumatic, electric or electromagnetic drive may be used.

The invention claimed is:

1. A detachable cutting head for an apparatus for feeding filter segments, the detachable cutting head comprising:

a housing; and a plurality of knife units fastened in the housing, each knife unit comprising:

a knife shaft having a diameter, and one or more circular knives mounted on the knife shaft, the circular knives having an outer edge and extending in planes parallel to one another, wherein the knife units are fastened in the housing such that the outer edges of the circular knives of adjacent knife units do not overlap with each other when viewed in a direction perpendicular to the planes in which the circular knives extend, wherein the housing comprises:

a first side wall and a second side wall opposite of the first side wall, the first and second side walls each having a front edge;

a first reference surface on the first side wall for positioning the housing in the apparatus in a given exact position;

a second reference surface on the second side wall for positioning the knife units within the housing in a given exact position;

seatings arranged at the first and second side walls for positioning knife units in the housing; and lead-out channels arranged in the second side wall of the housing, each lead-out channel having a width greater than the diameter of the knife shaft and extending from a respective seating through the front edge of the second side wall so that the knife unit can be removed from the housing by axially pushing the knife unit out of the seating arranged in the first side wall and thereafter moving the axially pushed-out knife unit along the lead-out channel through the edge of the second side wall, wherein the housing is configured such that the lead-out channels extend through the front edge of the second side wall from the seatings of the second side wall when the seatings of the first side wall are defined within the first side wall.

2. The detachable cutting head of claim 1, wherein the knife shafts have different lengths to allow for sequential coupling of the knife units to the apparatus for feeding filter segments.

3. The detachable cutting head of claim 1, wherein the knife shafts have equal lengths.

4. The detachable cutting head of claim 1, wherein the plurality of knife units comprises three knife units.

5. The detachable cutting head of claim 1, wherein each of the knife units comprises from 1 to 4 circular knives.

6. The detachable cutting head of claim 1, wherein the plurality of knife units comprises a first knife unit with one circular knife, and a second knife unit and a third knife unit each with a plurality of circular knives.

7. The detachable cutting head of claim 1, wherein the plurality of knife units comprises a first knife unit with one circular knife, a second knife unit with two circular knives, and a third knife unit with four circular knives.

8. The detachable cutting head of claim 1, wherein the seatings comprises three seatings on each of the first and second side walls.

9. The detachable cutting head of claim 1, wherein each of the knife shafts comprises an end piece at a first end of the knife shaft and a coupling element at a second end of the knife shaft.

10. The detachable cutting head of claim 9, wherein the end piece extends into one of the seatings on the first side wall.

11. The detachable cutting head of claim 1, wherein the housing comprises an opening for sliding the housing onto a mandrel of the apparatus.

12. The detachable cutting head of claim 1, wherein the housing comprises a handle.

* * * * *